United States Patent [19]

Degen

[11] Patent Number: 4,793,009

[45] Date of Patent: Dec. 27, 1988

[54] PIECE OF RECLINING FURNITURE

[75] Inventor: Hugo Degen, Seltisberg, Switzerland

[73] Assignee: Marpal AG, Switzerland

[21] Appl. No.: 1,644

[22] Filed: Jan. 9, 1987

[30] Foreign Application Priority Data

Jan. 13, 1986 [CH] Switzerland ..... 99/86
Jan. 13, 1986 [CH] Switzerland ..... 100/86

[51] Int. Cl.[4] ..... A47D 9/02

[52] U.S. Cl. ..... 5/103; 5/106; 5/108; 5/124

[58] Field of Search ..... 5/103, 106, 108, 109, 5/238–244, 118, 210, 124, 127; 297/260, 270

[56] References Cited

U.S. PATENT DOCUMENTS

| | | | |
|---|---|---|---|
| 159,086 | 1/1875 | Fowler et al. . | |
| 188,581 | 3/1877 | Buchanan | 5/103 |
| 238,843 | 3/1881 | Brown . | |
| 478,450 | 7/1892 | Meck | 5/129 X |
| 679,693 | 7/1901 | Spencer et al. . | |
| 683,837 | 10/1901 | Bernsdorff | 5/128 |
| 779,950 | 6/1903 | Lindsey | 5/244 |
| 888,045 | 5/1908 | Shaw | 5/104 |
| 889,065 | 5/1908 | Temples | 5/101 |
| 1,406,737 | 2/1922 | Hoy | 5/210 X |
| 1,732,008 | 10/1929 | Frantz | 5/129 X |
| 1,795,202 | 3/1931 | Dillingham . | |
| 1,798,546 | 3/1931 | Lillibridge . | |
| 2,377,464 | 6/1945 | Tucker | 5/244 |
| 2,581,483 | 1/1952 | Heller | 5/241 |
| 2,609,863 | 9/1952 | Paulich . | |
| 2,814,052 | 11/1957 | Kaiser | 5/243 |
| 3,125,767 | 3/1964 | Griggs et al. | 5/109 |
| 3,231,304 | 1/1966 | Coup | 5/118 |
| 3,849,812 | 11/1974 | Walsh | 5/108 |
| 4,419,778 | 12/1983 | Griffith | 5/244 |
| 4,567,614 | 2/1986 | Haider et al. | 5/103 |
| 4,615,059 | 10/1986 | Darowki . | |

FOREIGN PATENT DOCUMENTS

| | | | |
|---|---|---|---|
| 102546 | 8/1983 | European Pat. Off. . | |
| 3229934 | 9/1984 | Fed. Rep. of Germany . | |
| 8435922.6 | 12/1984 | Fed. Rep. of Germany . | |
| 8634 | 1/1904 | France | 5/129 |
| 2549912 | 1/1985 | France | 5/238 |
| 574307 | 12/1944 | United Kingdom . | |
| 696239 | 1/1951 | United Kingdom . | |
| 1451981 | 10/1976 | United Kingdom | 5/108 |
| 2141331 | 5/1984 | United Kingdom . | |

*Primary Examiner*—Michael F. Trettel
*Attorney, Agent, or Firm*—Browning, Bushman, Zamecki & Anderson

[57] ABSTRACT

On the fixed stand (1) of a piece of reclining furniture, a pendulum frame (2) is suspended in a freely oscillating manner via several tension members (52). Supporting elements (51) of the pendulum frame (2) project into the box-shaped bases (3) of the stand, which supporting elements (51) can be combined there with an amplitude limitation (54) on the one side and with a damping device (56, 57) on the other side.

12 Claims, 6 Drawing Sheets

Figure 5:
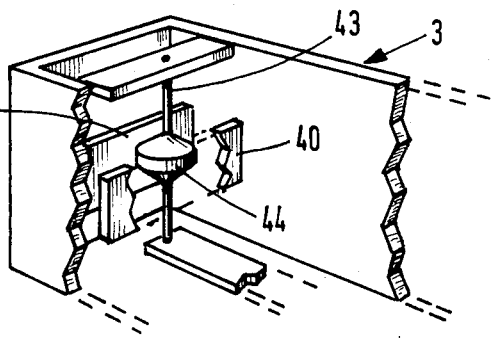

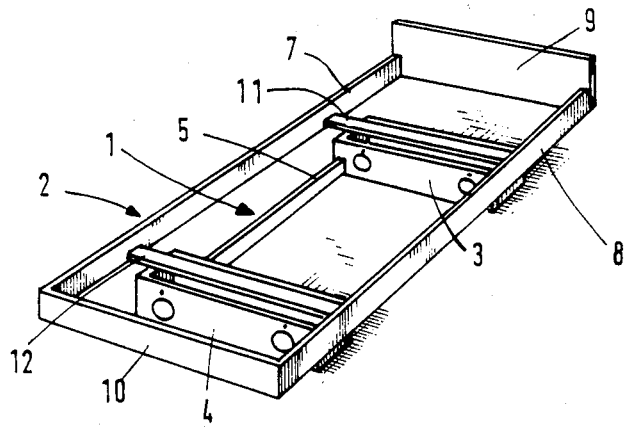
Fig.1
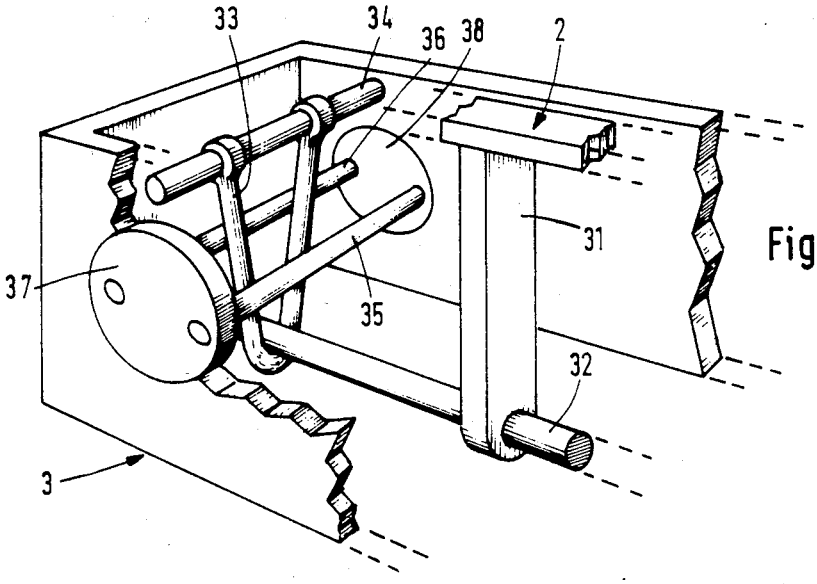
Fig. 2
Fig. 3
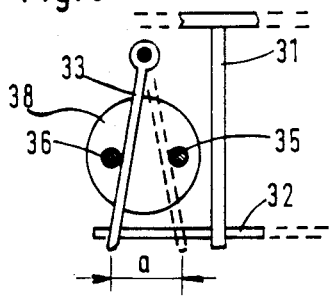
Fig. 4
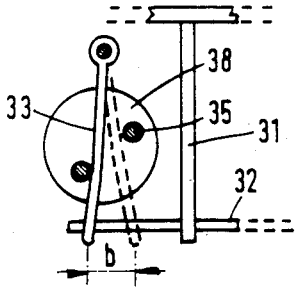

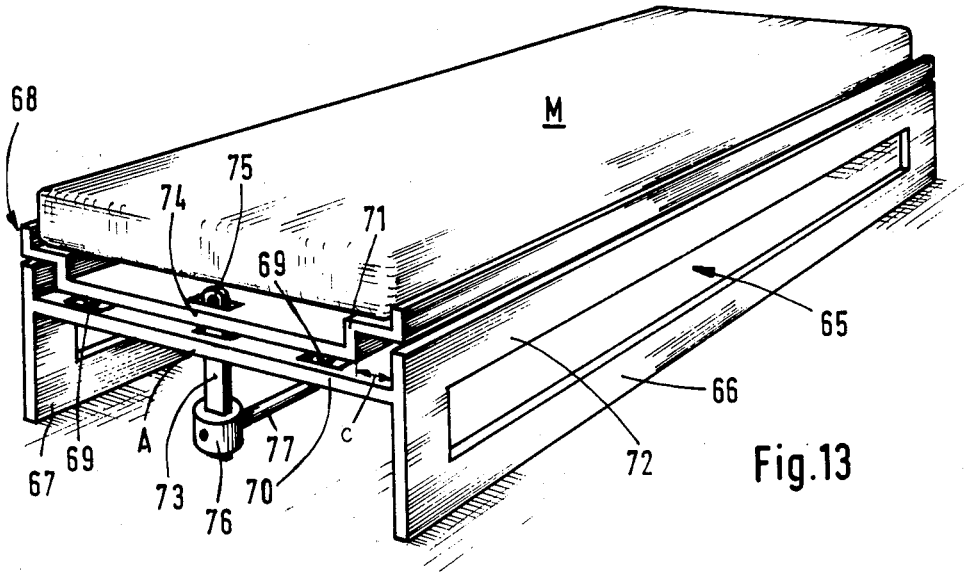
Fig.13
Fig.14
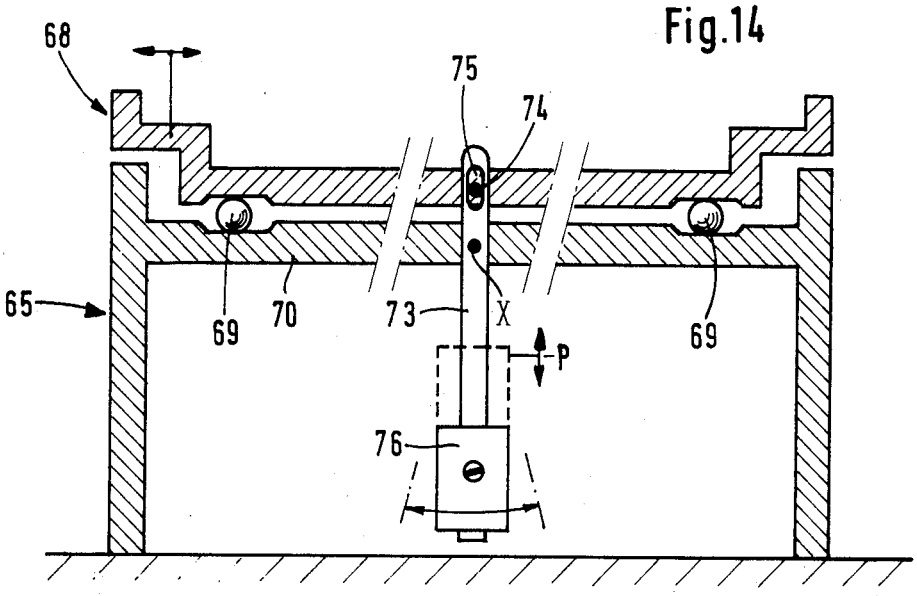

PIECE OF RECLINING FURNITURE

The invention relates to a piece of reclining furniture having a stand which supports a frame forming a reclining surface.

It relates in particular to a piece of reclining furniture having a fixed stand on which a pendulum frame is suspended in freely oscillating manner via at least three pendulums and is provided with a device for limiting the amplitude, with arresting members being arranged on both the fixed stand and the pendulum frame, at at least two locations at a distance from one another in the longitudinal direction of the reclining furniture, in order to lock the pendulum frame at either one location or both locations outside its centre position at the stand.

It is the object of the present invention to improve a piece of reclining furniture of this type, which is already the subject matter of the German Offenlegungsschrift No. 3,628,383, to the effect that the same is fully satisfactory from the three points of view of the daily upkeep of the bed, aesthetics, and the optimum damping of pendulum oscillation.

It is also the object of the present invention to propose such a piece of reclining furniture, the pendulum frame of which can also be subsequently attached in uncomplicated manner, and without impairing the pendulum function, to an existing stand.

The invention is defined in the independent patent claims 1 and 11. Various exemplary embodiments follow from the dependent patent claims.

Figure 6:
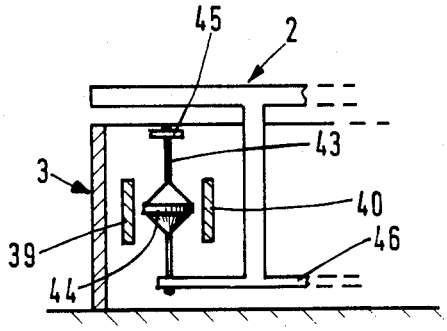
Figure 7:
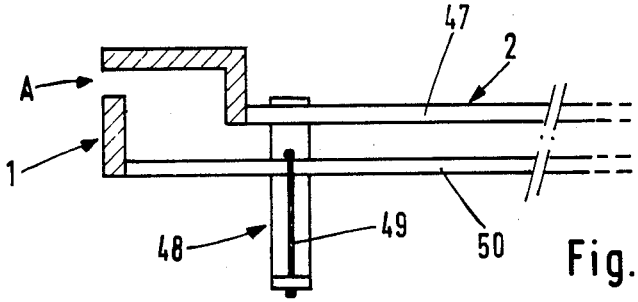
Figure 8:
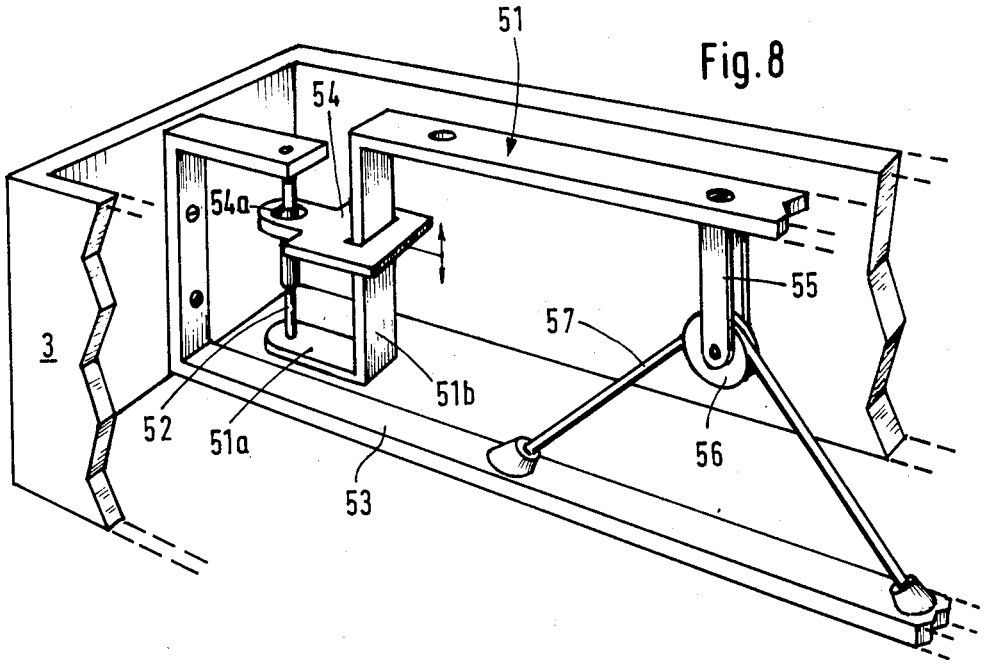
Figure 9A:
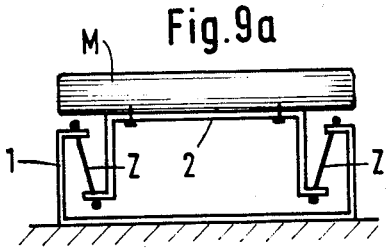
Figure 9B:
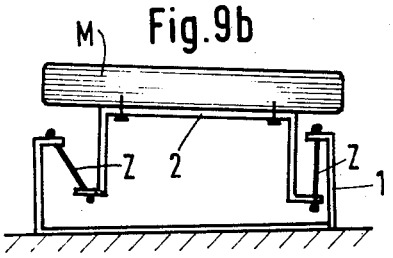
Figure 9C:
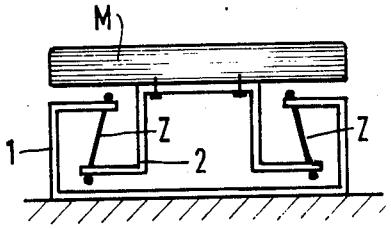
Figure 9D:
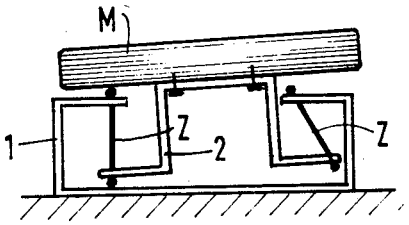
Figure 10:
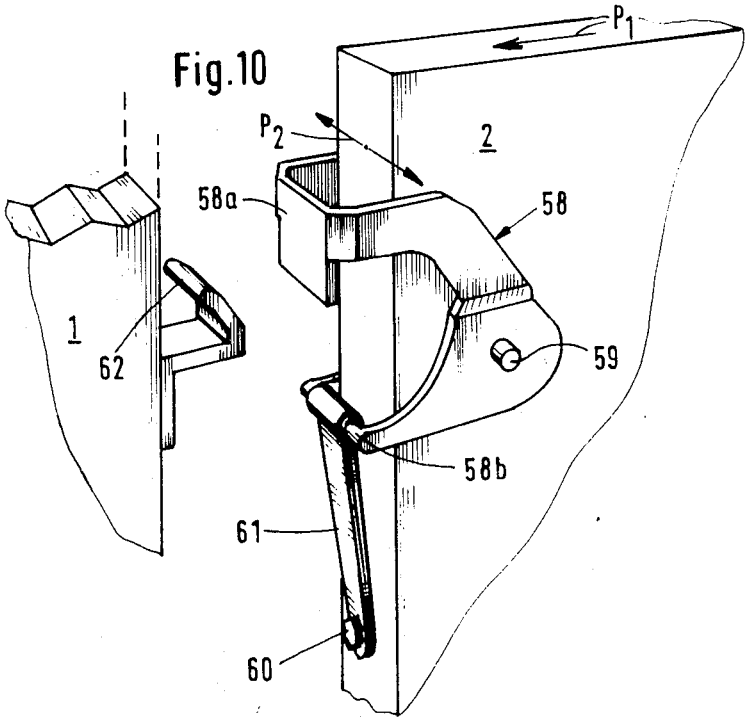
Figure 11:
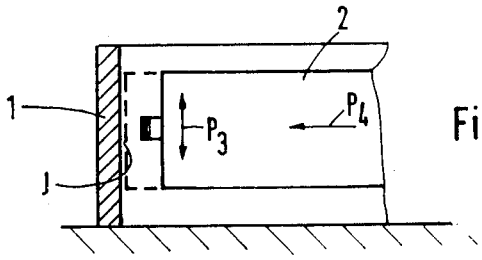
Figure 12:
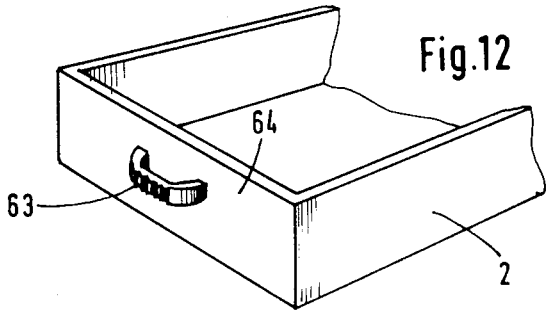
Figure 15:
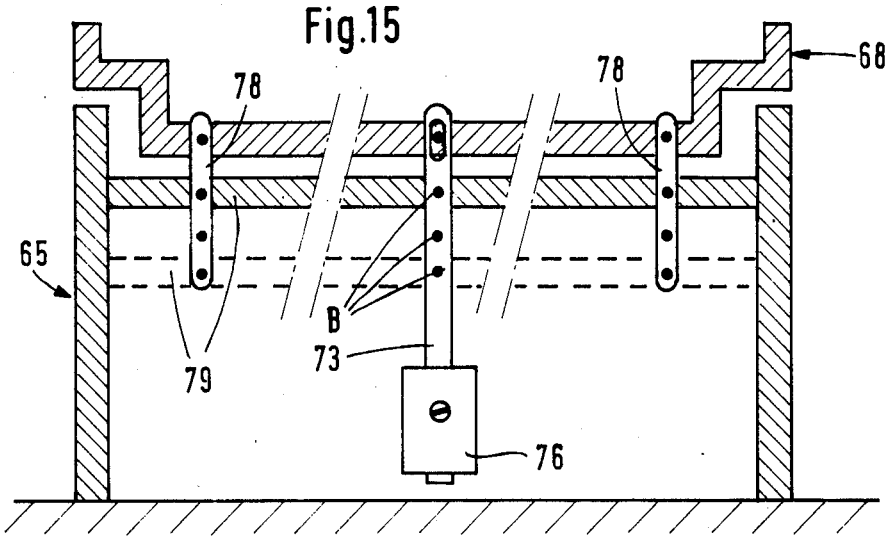
Figure 16:
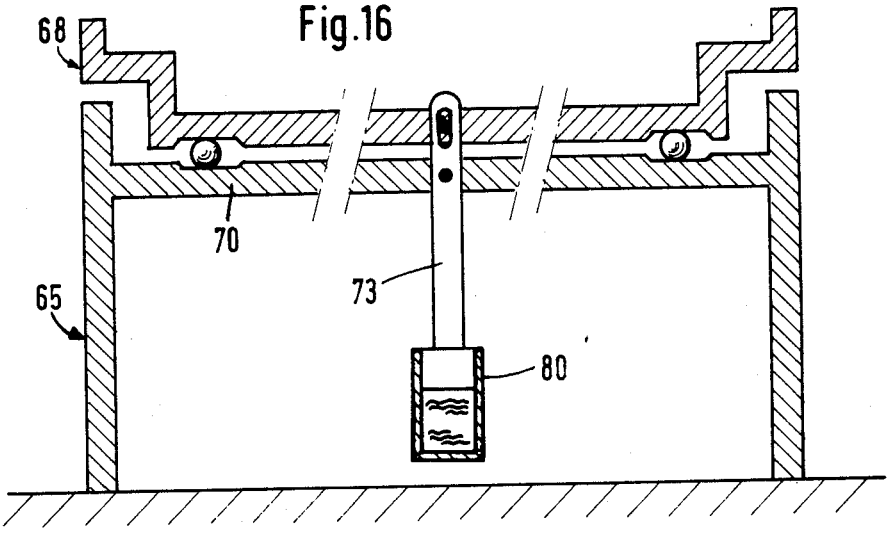

The attached drawing illustrates some exemplary embodiments of the inventive subject matter. In the drawing:

FIG. 1 shows a simplified perspective representation of a stand of a piece of reclining furniture with a mounted pendulum frame, FIG. 2 shows a perspective representation of a pendulum suspension with amplitude limitation, FIGS. 3 and 4 show two details of the embodiment according to FIG. 2, FIGS. 5 and 6 show a further embodiment of the amplitude limitation in the direction of the transverse axis of the piece of reclining furniture, FIG. 7 shows a further suspension variant which is especially suitable for subsequent mounting, FIG. 8 shows a perspective representation of a variant provided with amplitude limitation and oscillation damping, FIGS. 9A–9D show four end views of a piece of reclining furniture having tensions members lying at an inclined angle, FIG. 10 shows an embodiment variant of an arresting device, FIG. 11, shows a simplified plan view of a piece of reclining furniture having an oscillation brake, FIG. 12 illustrates the attachment of the brake member according to FIG. 11 to the pendulum frame, FIG. 13 shows a simplified perspective view of a first embodiment of such a piece of reclining furniture, FIG. 14 shows a transversely-running vertical section of this embodiment, and FIGS. 15 and 16 illustrate further embodiment variants by means of vertical sections.

A fixed stand 1 supports a pendulum frame 2 suspended on the stand 1 in oscillating manner. The stand 1 has two box-shaped bases 3 and 4 which are rigidly connected to one another by connecting bars one of which is shown at 5 and therefor.

The pendulum frame 2 has two longitudinal sides 7 and 8, two end faces 9 and 10, two cross pieces 11 and 12 and also the suspension device (still to be described) which engages on the cross pieces.

The bases 3 and 4 can be made according to FIG. 2, which shows a cut-away perspective view of the base 3. The pendulum frame 2 projects with two supports, one of which is shown at 31, into the inside of the base 3 and supports a cross bar 32 at the lower end of the support 31. The cross bar 32 is located in the lower section of a V-shaped pendulum suspension 33, the upper ends of which rotatably grip around a bar 34. The pendulum formed by the bars 32 and 34 and the suspension 33 thus permits an oscillating pendulum motion of the pendulum frame 2 relative to the fixed stand 1.

The pendulum amplitude—and therefore also the pendulum frequency—is limited by two parallel limiting rods 35 and 36 which are arranged on therefor opposite sides of the suspension 33 and are fixed with their ends in rotatable, cylindrical disks 37 and 38. Both disks 37 and 38 are mounted in corresponding recesses of the edge wall and can be turned manually or by a guide mechanism (not shown), for example a worm gear drive. Since this also changes a vertical projection of the spacing of the two bars 35 and 36, the amplitude and frequency of the described pendulum can be adjusted in this manner according to requirement, for example from a to b, as illustrated in FIGS. 3 and 4.

FIGS. 5 and 6 show a further possibility of limiting the amplitude and thus the frequency. A tension member 43 having a radial widened portion 44 is provided inside the base 3, and therefore also in the base 4, which widened portion 44 lies between two limiting strips 39 and 40 arranged on therefore opposite sides of the tension member. The widened portion 44, which can be made as a double cone, a ball etc, knocks against the two limiting strips 39 and 40 during pronounced oscillation and is therefore rapidly set in a steady oscillating motion. Here, the tension member 43 also connects the bracket 45 of the base 3 to the lower supporting strip 46 of the pendulum frame 2.

The variant according to FIG. 7 is suitable for the subsequent mounting of a pendulum frame 2 onto an existing piece of reclining furniture. Here, several arms of the type shown at 48 are fixed on the transverse side 47 of the pendulum frame 2, which arms 48 project downwards from the pendulum frame 2 and hang by means of tension members (e.g. steel cord 49 in the transverse sides e.g. 50, of the fixed stand 1. Corresponding devices for mutually arresting the stand 1 and the pendulum frame 2 can be arranged at the locations A in an embodiment already described or modified, but have been omitted in FIG. 7 for the sake of clarity.

In the embodiment of FIG. 8, The support beam 51 of the pendulum frame 2, which support beam 51 is of double-angled configuration, projects, again from above, into the base 3, of the stand 1. Tension members 52 are articulated on the one side on a beam 53 connected in fixed manner to the base 3 and on the other side on the lower angled portion **51*a* of the support beam 51. A plate 54 is mounted on the vertical leg 51*b* of the support beam 51 in a manner such that it can be displaced vertically and arrested in any position. The tension member 52 projects through a bore 54*a* made in this plate 54, the amplitude of oscillation of which tension member 52 is thus limited by the bore wall. The oscillating behaviour can be further varied by a vertical displacement of the plate 54**.

Moreover, an idle roller 56 is mounted on the support beam 51 via a retaining bracket 55, over which roller 56 is guided a flexible and/or elastic belt 57 which is fastened to the fixed beam 53. With this device, oscillation once stimulated can be dampened, which oscillation depends on the extensibility of the belt 57. An undesirable rebound effect of the oscillating system is kept within narrow limits by the interaction of the belt 57 with the idle roller 56.

If the tension members Z are arranged between the stand 1 and the frame 2 according to FIG. 9*a* such that their lower ends have a smaller mutual spacing than the upper ends, the mattress M lying on the pendulum frame tilts during the pendulum oscillation according to FIG. 9*b*, and a slight rolling motion of the resting body develops, which rolling motion can give a pleasant sensation.

Also, when the tension members are tilted according to FIG. 9*c* a corresponding tilt of the mattress M develops during the pendulum oscillation.

The pendulum frame 2 on the stand 1 can be locked at one or even at two locations by arresting members an embodiment of which is shown in FIG. 10.

At the transverse side of the pendulum frame 2, a catch 58 is mounted pivotably on the narrow side about an axis 59. The catch 58 is made in a bow shape and has an upper tooth 58*a* and also a lower transverse rod 58*b* on which a rubber strip 61 engages. Strip 61 is fixed at 60 to the pendulum frame. By displacing the pendulum frame 2 in the direction of the arrow $P_1$, it can be anchored on the stand 1 at the desired location in the hook 62. For releasing the anchorage, it is sufficient to push the pendulum frame in one direction of the double arrow $P_2$, whereupon it is pulled by the tension members into its neutral position.

When releasing the anchorage between the pendulum frame 2 and the stand 1, undesired pronounced oscillation of the pendulum frame can occur, depending on the design of the suspension. In order to counteract this, a brake member 63 can be fixed according to FIGS. 11 and 12 on the transverse side 64 of the pendulum frame 2, which brake member 63 can be, for example, a resilient rubber bow 63 projecting out of the plane of the transverse side 64. The pendulum frame 2 oscillating in the direction of the double arrow $P_3$ can be braked immediately by slight pressure exerted in the direction of the arrow $P_4$, with the brake member 63 rubbing against the inner surface of the side of the stand.

The piece of reclining furniture shown in FIG. 13 has a stand 65 which is supported on the floor by means of two longitudinally running bases 66 and 67. Above the stand 65 is located a pendulum frame 68 which rests on several rubber balls 69 which are arranged on a fixed transverse side 70 of the stand. Instead of the rubber balls 69, steel springs, for example, or other elastic support members, could also be used; non-elastic supporting will be described below with reference to FIG. 4.

The pendulum frame 68 has a side wall which is of double-angled configuration and which, in its lower section 71, has a clearance c relative to the side wall 72 adjacent to it, so that the pendulum frame can move in a freely oscillating manner inside this clearance on the rubber balls 69. A clearance can also be provided in the longitudinal direction between the frame 68 and the transversely running side wall of the stand. A mattress M lies on the pendulum frame.

As is further apparent from FIGS. 13 and 14, a double-arm lever 73 is rotatably mounted on the transverse side 70 of the stand by means of an axis X. The upper section of the lever 73, with a longitudinal slot 75, projects into a centre pin 74. At the lower end of the lever 73 is located an oscillating weight 76 which is matched to the weight of the loaded pendulum frame 68 and is rigidly connected via a bar 77 to a lever of the same type arranged at the opposite end of the stand of the piece of reclining furniture.

Owing to the described mounting of the pendulum frame 68, the pendulum frame 68, once the oscillating weight 76 has started in oscillating motion, is driven along by the latter during its pendulum motion and will therefore likewise execute a pendulum motion relative to the stand 65.

In the embodiment described in FIG. 13, this pendulum motion will run transversely to the axis of the piece of reclining furniture. But it would also be possible—and could readily be put into practice by one of skill in the art within the scope of the inventive idea—to provide a pendulum motion orientated in the direction of the longitudinal axis of the piece of reclining furniture. For this purpose, in the embodiment shown in FIGS. 13 and 14, the axes of the articulation locations X and 75 would merely have to be turned through 90° and the bar 77 connected in articulated manner to the oscillating weight 76.

As indicated by the arrow P in FIG. 14, the oscillating weight 76 can be displaceably arranged on the lever 73, as a result of which the amplitude and pendulum frequency can be varied.

FIG. 15, the reference numerals already introduced have been retained for like parts. Here, in contrast to the embodiment according to FIGS. 13 and 14, the pendulum frame 68 is connected to the stand 65 via several guide links 78, with the transverse side 79 of the stand 65 also being arranged in a vertically adjustable manner and the double-arm lever 73 having several bores B which enable the oscillating axis to be correspondingly shifted, as a result of which the pendulum behaviour of the pendulum frame can be varied.

According to FIG. 16, a hollow body 80 which can be filled with a flowable medium is located at the lower section of the lever 73, with which hollow body 80 the oscillating weight can be matched to the weight of the loaded frame 68 at will. The swashing motion of a liquid located in the hollow body 80 can help to achieve a desired pendulum action of the frame 68.

The oscillating weight 76 or 80 respectively connected to the pendulum frame 68 could also be arranged outside the longitudinal axis of the piece of reclining furniture.

What is claimed is:

1. A piece of reclining furniture having a longitudinal direction and a fixed stand on which a pendulum frame is suspended in freely oscillating manner via at least three pendulums and is provided with a device for limiting amplitude;

the stand having at least two bases which are arranged at a mutual distance, the bases being adapted for accommodating tension members which support the pendulum frame, the bases being made in a box shape and being connected into a rigid stand unit by means of connection elements, with the pendulum frame being supported on supporting members which, in the area of the two bases, are suspended in oscillating manner on the tension members;

the device for limiting the amplitude having a plate which is displaceable on the supporting member of the pendulum frame, the plate having a bore which encloses the tension member, an idle roller being arranged on the supporting member, over which roller a flexible belt runs, the belt being fastened on both sides of the roller to a part of the fixed stand.

2. A piece of reclining furniture having a longitudinal direction and a fixed stand on which a pendulum frame is suspended in freely oscillating manner via at least three pendulums and is provided with a device for limiting amplitude;

the stand having at least two bases which are arranged at a mutual distance, the bases being adapted for accommodating tension members which support the pendulum frame, the bases being made in a box shape and being connected into a rigid stand unit by means of connection elements, with the pendulum frame being supported on supporting members which, in the area of the two bases, are suspended in oscillating manner on the tension members;

the supporting members supporting the pendulum frame being suspended on at least approximately V-shaped pendulum members via oscillating bars arranged transversely to the longitudinal axis of the piece of reclining furniture, the pendulum amplitude of which pendulum members is limited by two parallel rods.

3. A piece of reclining furniture according to claim 2, wherein the bases have side walls, and the two parallel rods are fixed in disks which in turn are rotatably mounted in the side walls of the bases.

4. A piece of reclining furniture according to claims 1, 2 or 3, wherein there are a plurality of pairs of such tension members, the two tension members of each pair being arranged on opposite sides of the longitudinal axis of the piece of reclining furniture, and being tilted in opposite directions to one another in a neutral position of the pendulum frame in order to thus achieve a slight rolling motion of a reclining human body during the pendulum motion.

5. A piece of reclining furniture according to claim 4, wherein a brake member is fixed to an outer surface of a transverse side of the pendulum frame, which brake member is adapted, under slight axially exerted pressure to rub against an inner wall of a transverse side of the stand and thereby brake an undesirable oscillation of the pendulum frame.

6. A piece of reclining furniture according to claims 1, 2 or 3, wherein a brake member is fixed to an outer surface of a transverse side of the pendulum frame, which brake member is adapted, under slight axially exerted pressure to rub against an inner wall of a transverse side of the stand and thereby brake an undesired oscillation of the pendulum frame.

7. A piece of reclining furniture having longitudinal and lateral directions and a stand which supports a frame forming a reclining surface;

the frame being arranged with clearance in at least one of the lateral or longitudinal directions at the stand by means of support members which permit an oscillating relative movement between the stand and the frame, and a pendulum-like counterweight being articulated on the frame for the purpose of transmitting pendulum motion of the counterweight to the frame after the counterweight is pushed once;

the counterweight having a double-arm lever which hangs downwards from the longitudinal axis of the frame, the counterweight being rotatably mounted on the stand, movably connected to the frame and, at its lower end, supporting a pendulum weight matched to the weight of the loaded frame.

8. A piece of reclining furniture according to claim 7, wherein several levers are provided which hang downwards from the frame and, at their lower ends, are connected to one another by a continuous bar running parallel to the frame longitudinal axis.

9. A piece of reclining furniture according to claim 2, wherein the pendulum weight is a hollow body which can be filled with a flowable material.

10. A piece of reclining furniture according to claim 7, wherein the support bodies are guide links which are articulated on the frame and on a vertically adjustable side of the stand.

11. A piece of reclining furniture having longitudinal lateral directions and a stand which supports a frame forming a reclining surface, the frame being arranged with clearance in at least one of the lateral or longitudinal directions, at the stand by means of support members which permit an oscillating relative motion between the stand and the frame, and a pendulum-like counterweight being articulated on the frame for the purpose of transmitting pendulum motion of the counterweight to the frame after the counterweight is pushed once; said support members being rubber balls which form elastic support bodies.

12. A piece of reclining furniture according to claims 7, 8, 9, 10 or 11, wherein the pendulum weight is adjustably mounted on the lever.

* * * * *

UNITED STATES PATENT AND TRADEMARK OFFICE

CERTIFICATE OF CORRECTION

PATENT NO. : 4,793,009

DATED : December 27, 1988

INVENTOR(S) : Hugo Degen

It is certified that error appears in the above-identified patent and that said Letters Patent is hereby corrected as shown below:

In Column 6, line 39, insert --and-- before "lateral".

In Column 6, line 31, delete "2" and insert therefor --7--.

Signed and Sealed this

Twentieth Day of June, 1989

*Attest:*

DONALD J. QUIGG

*Attesting Officer*

*Commissioner of Patents and Trademarks*